US007383709B2

(12) United States Patent
Intagliata et al.

(10) Patent No.: US 7,383,709 B2
(45) Date of Patent: Jun. 10, 2008

(54) SYSTEM AND PROCESS FOR CRIMPING A FITTING TO A FLUID CONDUIT

(75) Inventors: Joseph Vincent Intagliata, Hanna, IN (US); Joshua Thomas Ruge, Porter, IN (US)

(73) Assignee: Custom Machining Services, Inc., Valparaiso, IN (US)

( * ) Notice: Subject to any disclaimer, the term of this patent is extended or adjusted under 35 U.S.C. 154(b) by 133 days.

(21) Appl. No.: 11/279,439

(22) Filed: Apr. 12, 2006

(65) Prior Publication Data

US 2007/0028660 A1 Feb. 8, 2007

Related U.S. Application Data

(60) Provisional application No. 60/705,622, filed on Aug. 4, 2005.

(51) Int. Cl.
*B21D 31/04* (2006.01)

(52) U.S. Cl. ..... 72/21.5; 72/402; 29/703

(58) Field of Classification Search ..... 72/14.8, 72/15.1, 21.4, 21.5, 402; 29/703, 701
See application file for complete search history.

(56) References Cited

U.S. PATENT DOCUMENTS 5,195,042 A * 3/1993 Ferraro et al. ..... 700/117
5,461,893 A * 10/1995 Tyler ..... 72/16.2
5,657,656 A * 8/1997 Evans et al. ..... 72/14.8
5,829,289 A * 11/1998 Fisher et al. ..... 72/19.9
6,505,494 B1 * 1/2003 Wollermann ..... 73/1.15
6,526,642 B2 * 3/2003 Sausner ..... 29/407.05

FOREIGN PATENT DOCUMENTS

EP 0637473 2/1995
EP 1108942 6/2001

* cited by examiner

*Primary Examiner*—Daniel C Crane
(74) *Attorney, Agent, or Firm*—Hartman & Hartman, P.C.; Gary M. Hartman; Domenica N. S. Hartman

(57) ABSTRACT

A system and process for performing a crimping operation by which a fitting is crimped to the end of a fluid conduit, and which automatically compensates for one or more variables that can lead to out-of-tolerance crimp diameters, particularly fitting spring-back and crimper deflection. The system and method use a device for inputting into the system a targeted crimp diameter for the fitting, and a crimper for crimping the fitting to the end of the fluid conduit. The crimper comprises a plurality of dies and an actuator for contracting the dies around the fitting to obtain the targeted crimp diameter for the fitting. The system and method further includes a unit for attaining the targeted crimp diameter by automatically compensating contraction of the dies for spring-back of the fitting during crimping and/or deflection of the crimper during crimping.

22 Claims, 7 Drawing Sheets

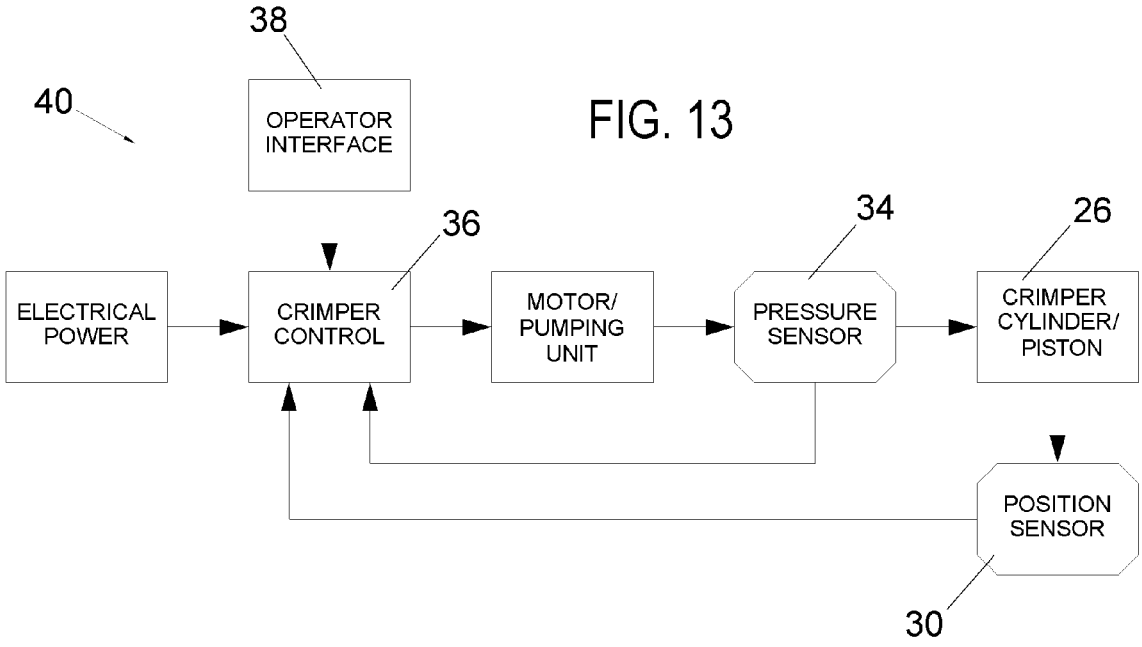
FIG. 13
FIG. 14
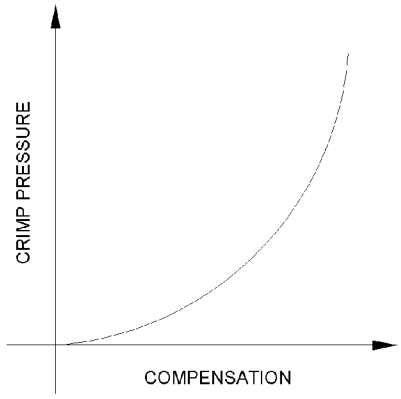

38

38

38

SYSTEM AND PROCESS FOR CRIMPING A FITTING TO A FLUID CONDUIT

CROSS REFERENCE TO RELATED APPLICATIONS

This application claims the benefit of U.S. Provisional Application No. 60/705,622, filed Aug. 4, 2005, the contents of which are incorporated herein by reference.

BACKGROUND OF THE INVENTION

The present invention generally relates to equipment and processes for attaching components together by compressing one of the components around the other. This invention particularly relates to a system and process for crimping a fitting to the end of a conduit to consistently achieve a targeted crimp diameter for the fitting.

Crimping processes generally involve a set of tooling, such as a die set, that is forced closed around a fitting loosely assembled onto the end of a conduit, such as a hose or tube adapted to transport a fluid or protect electrical wiring or other hardware susceptible to damage. A representative hydraulic hose and fitting assembly 10 is depicted in FIG. 1 as including a hose 12 and fitting 14, with the end 16 of the hose 12 being received and trapped between an inner stem 18 and outer ferrule 20 of the fitting 14. The crimping action is the result of the die set (not shown), arranged around the circumference of the ferrule 20, being collapsed in a controlled manner onto the ferrule 20 to apply a crimping force radially inwardly toward the centerline of the hose 12, as indicated in FIG. 1. To meet reliability and manufacturing standards, the die set used to crimp the fitting 14 must sufficiently compress the fitting 14 to lock the fitting 14 onto the hose end 16. For this purpose, manufacturers typically designate a final crimp diameter "$D_c$" and allowable tolerance for a given type and size of fitting 14 and hose 12.

Crimping equipment often rely on a hydraulic cylinder to actuate the die set, such that the required crimping force is directly related to the hydraulic pressure within the cylinder. FIGS. 2 through 4 illustrate three commonly used approaches to the application of pressure during a crimp cycle. FIG. 2 shows a crimp cycle in which the pressure gradually and nonlinearly increases during the cycle. FIG. 3 shows an example of the pressure being increased and then held steady to finish the crimp. In FIG. 4, the pressure increases but is then allowed to drop toward the end of the cycle. Various other pressure cycles are also possible, and the following discussion is not limited to the pressure cycles represented in FIGS. 2 through 4.

Typical crimping equipment and dies are designed to accommodate a range of hose and fitting sizes and types. It can be appreciated that the crimping force required to produce a reliable crimp increases as the diameters of the fittings increase. It is also true that heavier hoses and fittings, in other words, those that contain more material that must be compressed during crimping, also require much greater crimping forces than lighter hoses and fittings of the same diameter. This relationship is represented in FIG. 5, and can be seen to be nonlinear.

Another consideration during crimping is how the hose 12 and fitting 14 respond to a crimp. Due to material being compressed and plastically deformed during crimping, the diameter of the fitting 14 (as measured by the diameter of the ferrule 20 in FIG. 1) naturally expands slightly after a crimp toward its original shape, a phenomenon that will be referred to as fitting spring-back. The amount of spring-back is a significant part of the crimping process that varies from fitting to fitting. FIG. 6 represents that heavier fittings result is more spring-back than lighter ones, again in a nonlinear relationship.

In addition to the above factors, the pressure necessary to attain a required crimp diameter is further complicated by tolerances and variations in manufacturing hoses and fittings. Tolerances may result in different crimping forces/pressures being required to attain a required crimp diameter for a quantity of a particular type of hose/fitting combination.

In an effort to more reliably attain a desired crimp diameter, crimpers typically utilize either pressure or position of the hydraulic cylinder to adjust the crimp diameter. FIG. 7 shows a flow chart for a crimper controlled by pressure. Monitoring pressure is usually only effective for very light and small fittings, especially those manufactured to relative tight tolerances so that the pressure required to achieve a desired crimp diameter is more consistent from crimp to crimp. As the fittings and hoses get bigger, the size variation between fittings tends to increase due to tolerances, with the result that the pressure to achieve a desired crimp diameter can significantly vary from fitting to fitting, for the reasons discussed previously with respect to FIG. 5. For crimp cycles that operate with a gradually increasing pressure as represented in FIG. 2, monitoring the pressure to control the crimp can generally be reasonably achieved. However, for crimp cycles of the type shown in FIGS. 3 and 4, reliable control of the pressure to obtain a desired crimp diameter becomes complicated. As a result, monitoring pressure to control a crimping cycle is very limited and not widely used.

In view of the above, positional feedback is more widely used as a method for making crimps. This type of control system is represented in FIG. 8. To illustrate the following discussion, reference is made to FIGS. 9 and 10, which show a crimper 22 whose die set 24 is in fully open (expanded) and fully closed (contracted) positions, respectively. The die set 24 is shown as being actuated with a piston 26 of a hydraulic cylinder 27. Typically, the linear travel of the piston 26 can be directly correlated to the diameter $D_d$ of the die set 22 through knowledge of the camming surfaces 32 between the die set 24 and piston 26. As such, the position of the piston 26 relative to a suitable reference is often monitored with this control method. A limit switch or position transducer (not shown) is typically mounted externally on the crimper 22 to provide feedback of the position of the piston 26. The limit switch or transducer must be mounted on the crimper 22 away from the hose and fitting (not shown) so that it is not damaged during use of the crimper 22 and does not interfere with the crimping process. For this reason, for crimpers similar to the type shown in FIGS. 9 and 10, the position of the piston 26 is usually monitored based on the distance between the piston 26 and the front plate 28 of the crimper 22.

As seen in FIG. 10, the front plate 28 tends to deflect during the crimp cycle as a result of the die set 24 being retained in the crimper 22 with the front plate 28. This deflection affects any position measurements of the piston 26 taken with respect to the front plate 28. As fittings vary, the required pressure varies, and the deflection in the front plate 28 also varies, with higher pressures resulting in greater deflection as shown in FIG. 11. FIG. 12 shows another relationship that exists between the die set diameter $D_d$ and the deflection of the crimper front plate 28. From FIG. 12, it can be understood that a position reading made during crimping of a fitting that causes only minor deflection will result in a smaller die set diameter $D_d$ than the same position reading for a different fitting whose crimping causes significant deflection. As such, monitoring crimper position generally works well as a control method, but can be inaccurate due to crimper deflection.

In view of the above discussion, current crimper technology requires the operator to constantly monitor the crimping process and make adjustments as required. Though a given hose and fitting combination will have unique specifications that require certain crimper settings to achieve a desired crimp diameter $D_c$, the operator must also adjust for variances in individual hoses and fittings attributable to tolerances. Many crimper settings do not provide for any spring-back in a hose and fitting assembly, necessitating that the operator measure each crimped assembly and re-crimp to a smaller diameter if the assembly is out of tolerance. Crimp settings also do not allow for crimper deflection, representing yet another reason for operators to measure each crimped assembly and re-crimp if necessary. Because the crimp diameter will typically be out of tolerance due to a combination of fitting spring-back and crimper deflection, it is not uncommon for some hose/fitting assemblies to require multiple crimps before their crimp diameter falls within an acceptable range.

From the above, it can be appreciated that, while crimp operators can identify and fix defective crimps as they occur, it would be desirable if variables that cause defective crimps could be automatically compensated for.

BRIEF SUMMARY OF THE INVENTION

The present invention provides a system and process for performing a crimping operation by which a fitting is crimped to the end of a fluid conduit, and which automatically compensates for one or more variables that can lead to out-of-tolerance crimp diameters, particularly fitting spring-back and crimper deflection. The invention overcomes many of the problems arising from variances often present in hoses and fittings that affect fitting spring-back and crimper deflection.

The system of this invention includes means for inputting into the system a targeted crimp diameter for the fitting, and means for crimping the fitting to the end of the fluid conduit. The crimping means comprises a plurality of dies and an actuating means for contracting the dies around the fitting to obtain the targeted crimp diameter for the fitting. The system further includes means for attaining the targeted crimp diameter by automatically compensating the contraction of the dies for spring-back of the fitting during crimping and/or deflection of the crimping means during crimping.

The process of this invention includes inputting into the system a targeted crimp diameter for the fitting around the end of the fluid conduit, crimping the fitting to the end of the fluid conduit with a crimping means comprising a plurality of dies and an actuating means that contracts the dies around the fitting to obtain the targeted crimp diameter and, during the crimping step, attaining the targeted crimp diameter by automatically compensating contraction of the dies for spring-back of the fitting and/or deflection of the crimping means during crimping.

A significant advantage of this invention is that the system and process compensate a crimping operation by factoring in the influence that fitting spring-back and crimper deflection have on the die set diameter and pressure, resulting in the elimination or at least significant reduction in the number of crimping cycles needed to identify crimping settings that will achieve a desired crimp diameter. The invention also eliminates or at least significant reduces the need to check crimp diameters of individual hose and fitting assemblies once the proper crimping settings are determined for a given type of hose and fitting assembly.

Other objects and advantages of this invention will be better appreciated from the following detailed description.

BRIEF DESCRIPTION OF THE DRAWINGS

FIG. 13 is a schematic of a control system suitable for use in controlling crimp diameters in accordance with the present invention.

FIG. 14 is a graph representing the relationship between travel compensation and crimping pressure used in the control system of FIG. 13 in accordance with a preferred embodiment of the present invention.

DETAILED DESCRIPTION OF THE INVENTION

Figure 1:
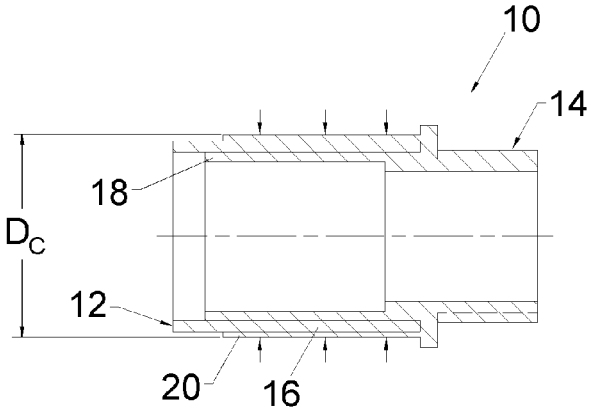
FIG. 1 is a fragmentary cross-sectional view of a hose and fitting assembly of a type that can be crimped in accordance with this invention.
Figure 2:
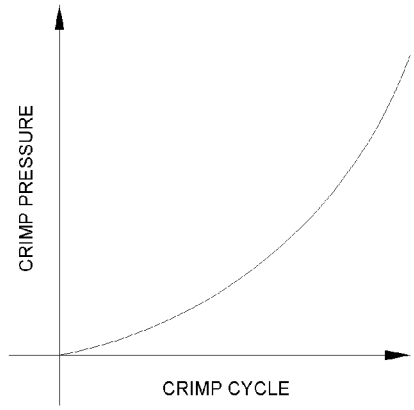
FIGS. 2 through 4 represent pressure cycles of types typically employed in crimping cycles.
Figure 3:
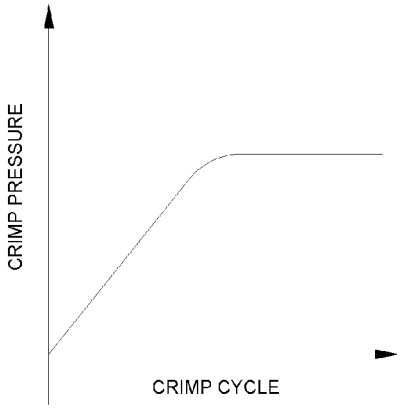
Figure 4:
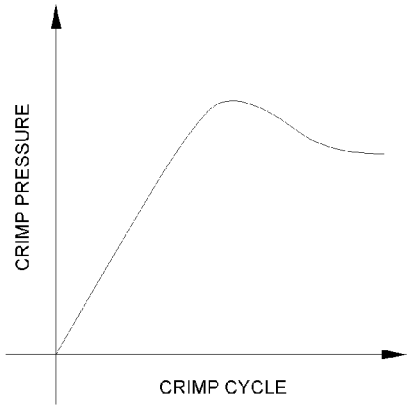
Figure 9:
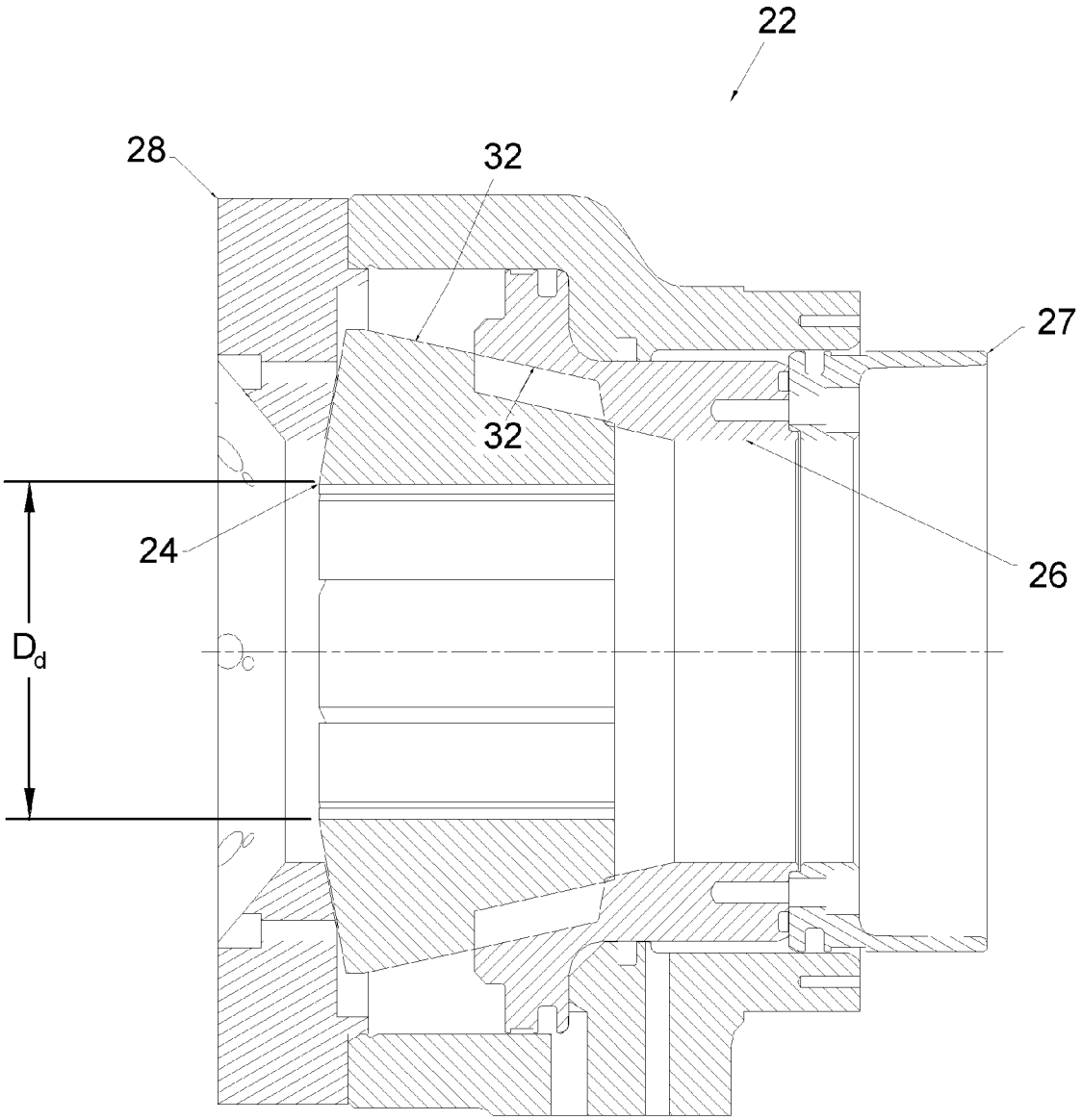
FIGS. 9 and 10 illustrate the tendency for deflection to occur within a crimper during a crimping cycle.

The present invention provides a crimping system and method by which more accurate crimp diameters can be achieved for a wide variety of hose and fitting sizes and types. As represented in FIG. 13, the system 40 and method employ a compensation algorithm that uses both pressure and position as inputs. The system 40 and method can be used to crimp a variety of hose and fitting types, such as the type represented in FIG. 1, and can be used to control a variety of crimpers, including the crimper 22 represented in FIGS. 9 and 10. As such, the following description of the invention will be make reference to the hose and fitting assembly 10 of FIG. 1, the crimper 22 of FIGS. 9 and 10, and their components. However, those skilled in the art will appreciate that the present invention is also applicable to other types of hoses, fittings, and crimper designs, including scissor-type crimpers well known in the art.

As with prior art crimpers, the invention makes use of a position sensor (30 in FIG. 13), such as a limit switch or position transducer, to sense the position of the die set 24 within the crimper 22, and therefore the die set diameter $D_d$. For example, the travel of the piston 26 can be used to indicate the die set diameter $D_d$ in view of the linear relationship evident from the camming surfaces 32 of the die set 24 and the piston 26. Simultaneously, the invention makes use of a pressure sensor (34 in FIG. 13) to monitor the force generated by the die set 24. In the crimper 22 of FIGS. 9 and 10 in which the die set 24 is actuated by a piston 26 mounted to a hydraulic cylinder 27, the pressure of the hydraulic fluid used to actuate the cylinder 27 is convenient to monitor for this purpose. The relationships between pressure and fitting spring-back and deflection evident from FIGS. 5, 6, and 11 also make pressure a convenient input for use in this invention to improve the crimping accuracy. However, it should be understood that other means could be used to measure or otherwise monitor the force generated by the die set 24.

Figure 15:
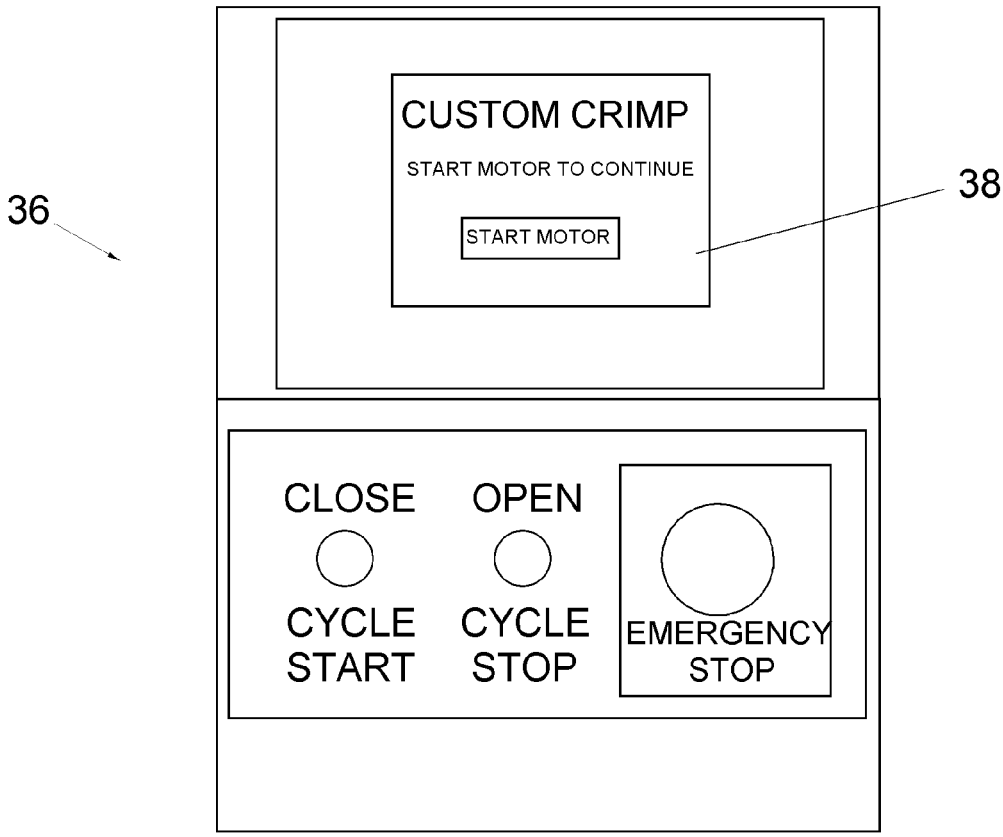
FIG. 15 depicts a suitable controller for use with the control system and method of the present invention.

FIG. 13 represents the system 40 as having a controller 36 communicating with an operator interface 38, the latter of which is used to input crimp diameter $D_c$ and the closed diameter of the die set 24 into the controller 36. FIG. 15 represents the interface 38 as being integrated with the controller 36 as a touchscreen 38 by which these inputs and other control and adjustment information can be input into the system 40, as will be discussed in greater detail below. As represented in FIG. 13, the output of the position and pressure sensors 30 and 34 provide the feedback to the controller 36 to perform the compensation algorithm of this invention.

Figure 5:
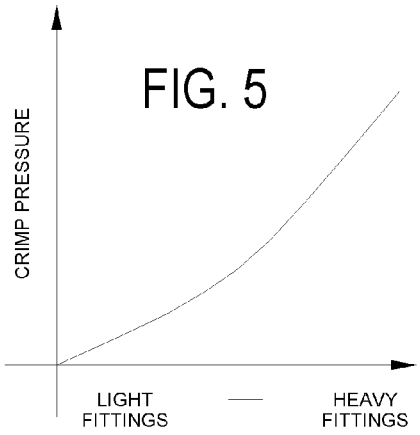
FIG. 5 is a graph representing the influence that fitting size has on the pressure required to obtain a desired crimp diameter.

As illustrated by FIG. 5, the pressure required to achieve a desired crimp diameter $D_c$ is directly related to how heavy the hose and fitting are, in other words, the combined influence of the size, type, materials, and amounts (volume, mass) of the materials that form the hose 12 and fitting 14. According to the invention, by simultaneously monitoring crimping pressure during a crimping cycle with a preset piston position corresponding to the desired crimp diameter $D_c$, light and heavy hose and fitting combinations can be automatically detected by sensing the crimping pressure as the piston 26 approaches its preset position. From FIG. 5, it can be appreciated that as the die set 24 of the crimper 22 approaches the required crimp diameter $D_c$, additional travel may be required depending on the pressure required to achieve the crimp diameter $D_c$. According to the present invention, as the hydraulic pressure sensed by the pressure sensor 34 increases, the controller 36 automatically increases the amount of travel of the piston 26 and therefore compensates for heavier fittings. FIG. 14 is a graph based on empirical data that evidences a nonlinear relationship exists between sensed fluid pressure and the amount of piston travel compensation required to produce desired crimp diameters for various fitting assemblies. In particular, the empirical data suggests a roughly exponential compensation algorithm that the controller 36 can apply to the travel of the piston 26 based on the fluid pressure sensed by the pressure sensor 34. As such, the system 40 does not employ the conventional practice of using only piston position to achieve a desired crimp diameter $D_c$. Instead, the system 40 of this invention uses an algorithm that provides compensation relative to increasing pressure by providing an automatic, rapid, and corrective adjustment to piston position as higher pressures associated with heavy fittings are encountered.

Figure 6:
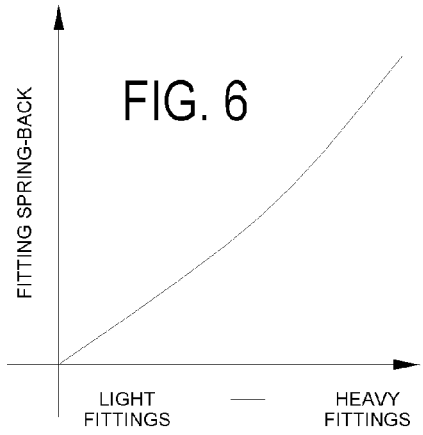
FIG. 6 is a graph representing the influence that fitting size has on the amount of fitting spring-back that occurs at the completion of a crimping cycle.
Figure 7:
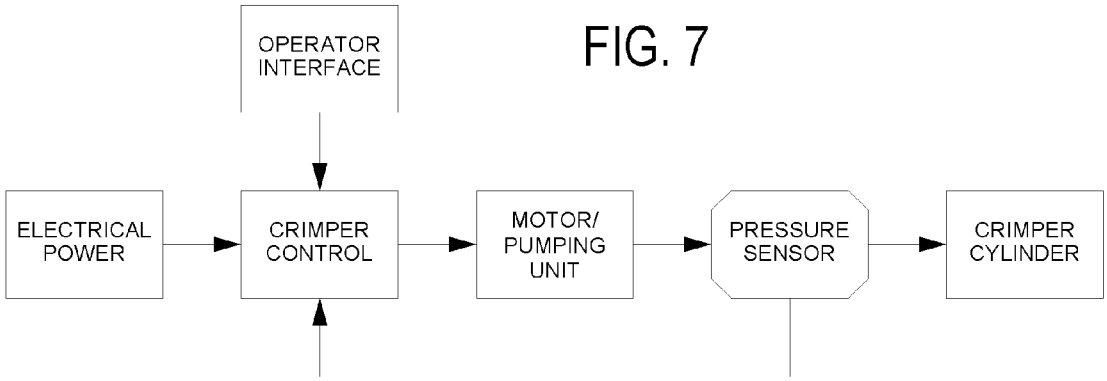
FIGS. 7 and 8 are schematics of control methods used to control crimp diameters in accordance with the prior art.
Figure 8:
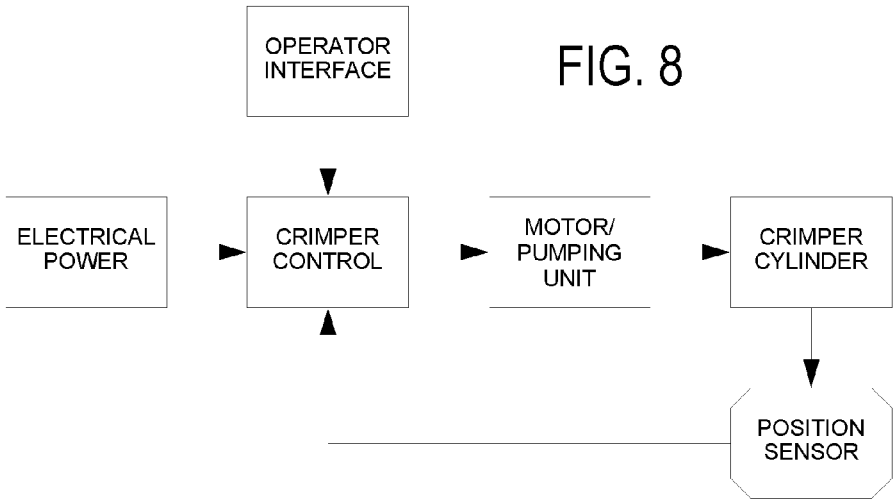

By compensating for heavier fittings by increasing the travel of the piston 26, the controller 36 also compensates for spring-back of the hose 12 and fitting 14 at the end of the crimping cycle when the die set 24 is retracted. This phenomenon, previously discussed with reference to FIG. 6, is characterized by a relationship between spring-back and the size, type, material, etc., of the fitting 14, and is similar to the relationship between the crimp pressure and the size, type, material, etc., of the fitting 14 represented by FIG. 5. This similarity can be understood from the observation that heavier fittings 14 would tend to spring back more than lighter fittings 14. On this basis, the invention simultaneously uses pressure to determine how much additional travel of the piston 26 is required to compensate for spring-back. As the crimp pressure increases, the fitting 14 is crimped to a smaller crimp diameter $D_c$.

Figure 10:
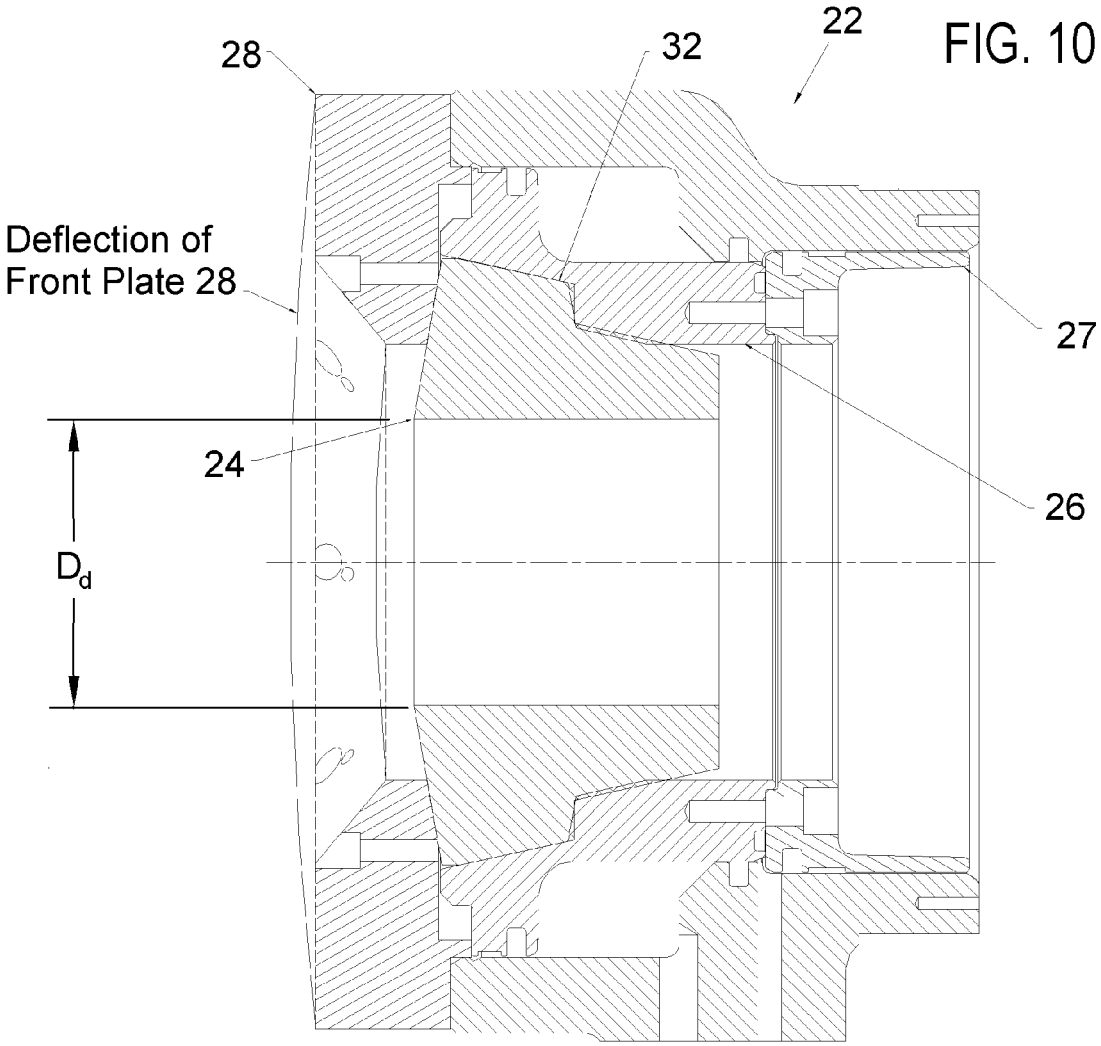
Figure 11:
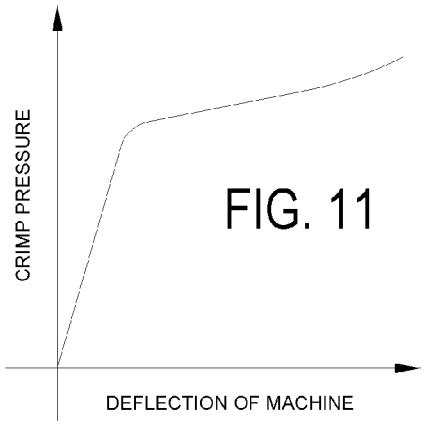
FIG. 11 is a graph representing the relationship between crimping pressure and crimper deflection.

Another desirable result of controlling the crimper 22 based on position of the piston 26 and compensated with pressure is the effect of also compensating for deflection in the crimper 22, or as discussed with reference to FIG. 10, the front plate 28 of the crimper 22. FIG. 11 was previously described as showing that as the crimp pressure increases, the deflection in the crimper 22 also increases. By monitoring the pressure to determine the required compensation according to the compensation curve of FIG. 14, the die set 24 will close farther and automatically compensate for any deflection in the crimper 22.

Figure 16:
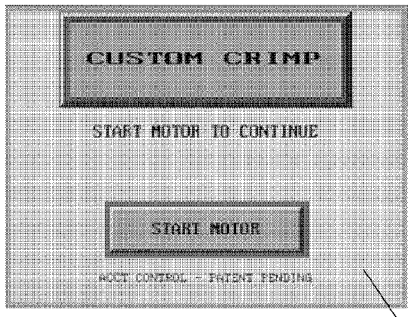
FIGS. 16 through 21 represent input windows used to input data to the controller of FIG. 15 in accordance with a preferred embodiment of the present invention.
Figure 17:
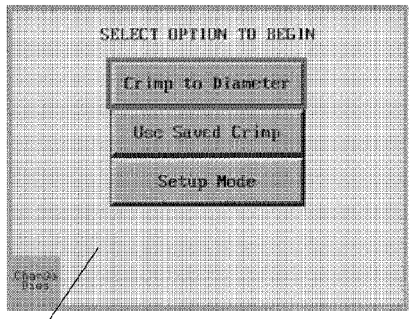
Figure 18:
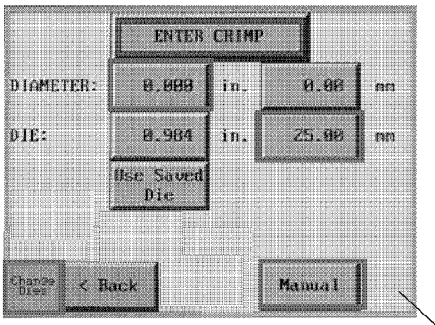
Figure 19:
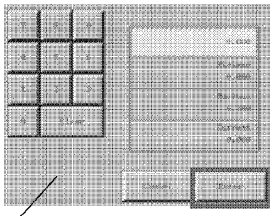

A typical operation sequence made possible with the present invention is described in reference to FIGS. 16 through 20, which represent input screens generated by the touchscreen 38 of the controller 36 shown in FIG. 15. An example of a suitable start screen is represented in FIG. 16. Pushing the "START MOTOR" button of the touchscreen 38 brings the operator to the screen shown in FIG. 17. As with conventional crimpers, two inputs are required to initiate a crimp cycle: the closed diameter of the die set 24 when fully contracted, and the desired crimp diameter $D_c$. At the screen shown in FIG. 17, the operator presses "CRIMP TO DIAMETER," which brings up the screen shown in FIG. 18. At this point, the operator enters the closed diameter and the crimp diameter $D_c$ by pressing the "DIE" and "DIAMETER" buttons of the touchscreen 38, respectively. When either "DIE" and "DIAMETER" is pressed, the screen shown in FIG. 19 is brought up, providing a data input pad. According to a preferred aspect of the invention, the crimp diameter $D_c$ and die set closed diameter inputs can be entered in any combination of metric and English units, e.g., inches ("IN") and millimeters ("MM"), as the controller 36 accepts and converts any combination of these inputs. As such, the controller 36 does not require an operator to perform a conversion when faced with, for example, using a metric die set 24 to produce a crimp diameter $D_c$ specified in English units.

Figure 20:
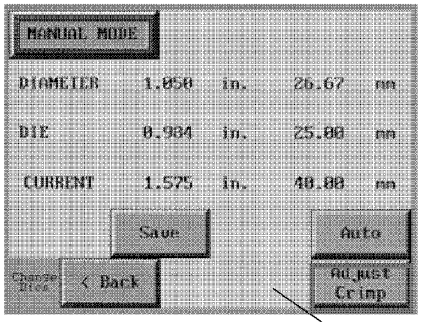
Figure 21:
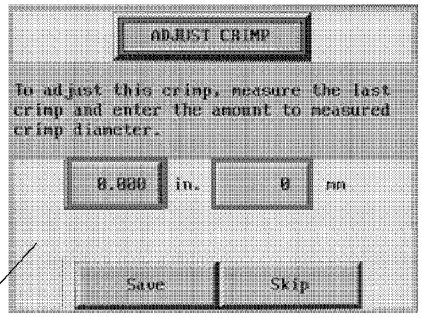

Once the crimp diameter $D_c$ and closed diameter are entered, the operator presses the "MANUAL" button of the touchscreen 38 to place the crimper 22 and controller 36 in manual mode, at which time the operator is able to perform a first crimp cycle to confirm that the desired crimp diameter $D_c$ is obtained with the particular combination of hose 12 and fitting 14 being used. The crimp diameter $D_c$ of the crimped assembly 10 can be measured manually with a micrometer. Because of the compensation algorithm employed by the controller 36, the likelihood of an incorrect crimp diameter $D_c$ is greatly reduced compared to prior art crimpers. However, if a minor correction is necessary because the crimp diameter $D_c$ falls outside the tolerance range established for the hose and fitting assembly 10, the controller 36 and its touchscreen 38 enable such corrections to be made in a simple step that does not require the operator to perform any computations. Instead, FIG. 20 shows a screen displayed on the touchscreen 38 at the completion of the crimp cycle, with an "ADJUST CRIMP" button. Pressing this button causes the screen shown in FIG. 21 to appear, where the operator simply enters the measured crimp diameter $D_c$ of the hose and fitting assembly 10. The controller 36 then automatically calculates the difference between the desired and actual crimp diameters, and calculates the amount of travel adjustment needed for the piston 26 to obtain the desired crimp diameter $D_c$. The measured crimp diameter can be input in either metric or English units by pressing the appropriate region of the touchscreen 38, which brings up an input screen similar to that of FIG. 19. While a single correction will usually bring the assembly 10 into specification, the correction process can be repeated as many times as may be required.

Because tolerances and other factors can occur over the course of numerous crimping cycles that can cause the actual crimp diameter $D_c$ to drift, the controller 36 preferably includes a screen (not shown) that allows the operator or others to set a maximum number of crimping operations that can be performed before the system 40 stops and requires the operator to perform and manually input another crimp diameter measurement.

Figure 12:
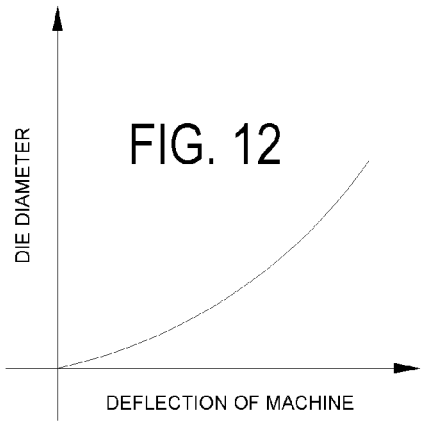
FIG. 12 is a graph representing the influence that crimper deflection has on the die diameter during a crimping cycle.

From the above, it can be appreciated that the crimper 22 controlled with the controller 36 and compensation algorithm of this invention is capable of more precisely and reliably obtaining a desired crimp diameter as a result of modifying the travel of the cylinder piston 26 (and therefore the die set diameter $D_d$) based on the pressure required as the die set 24 approaches the crimp diameter $D_c$. According to conventional practice, the position sensor 30 employed by this invention to sense the position of the piston 26 (corresponding to the die set diameter $D_d$ of the die set 24) would be used to determine when the die set 24 arrived at the targeted die set diameter $D_d$ during crimping. However, the present invention adjusts the travel of the piston 26 based on the pressure sensed by the pressure sensor 34, which effectively senses the effort required to make the crimp. Based on FIGS. 5 and 6, this adjustment based on pressure is able to compensate for varying levels of spring-back attributable to variations in hose and fitting combinations. Based on FIG. 11, this adjustment based on pressure is also able to compensate for the deflection of the crimper 22 which, as seen from FIG. 12, also creates errors in the die set diameter $D_d$ relative to the position of the piston 26. As a result, an operator is able to enter the desired crimp diameter $D_c$ and will seldom be required to manually calculate and enter an offset to achieve the correct crimp diameter $D_c$.

While the invention has been described in terms of a preferred embodiment, it is apparent that other forms could be adopted by one skilled in the art. For example, the physical configuration of the hose, fitting, crimper, and controller could differ from that shown, and process steps other than those noted could be use. Therefore, the scope of the invention is to be limited only by the following claims.

The invention claimed is:

1. A system for crimping a fitting to an end of a fluid conduit, the system comprising:

means for inputting into the system a targeted crimp diameter for the fitting around the end of the fluid conduit;

means for crimping the fitting to the end of the fluid conduit, the crimping means comprising a plurality of dies and an actuating means for applying a force to cause the dies to travel toward and contract around the fitting to the targeted crimp diameter; and means for attaining the targeted crimp diameter for the fitting by automatically increasing the contraction of the dies around the fitting based on the force applied by the actuating means at the targeted crimp diameter and thereby compensate for at least one of spring-back of the fitting during crimping and deflection of the crimping means during crimping.

2. The system according to claim 1, wherein the attaining means automatically increases the contraction of the dies by automatically increasing travel of the actuating means.

3. The system according to claim 2, wherein the attaining means utilizes travel of the actuating means as an input from which the attaining means automatically increases the contraction of the dies.

4. The system according to claim 1, wherein the attaining means automatically increases the contraction of the dies with a nonlinear algorithm relative to increasing force applied by the actuating means.

5. The system according to claim 1, wherein the actuating means comprises a hydraulic cylinder actuated with fluid under pressure.

6. The system according to claim 5, wherein the attaining means utilizes the pressure of the fluid as an input from which the attaining means monitors the force and automatically increases the contraction of the dies.

7. The system according to claim 6, wherein the attaining means automatically compensates the contraction of the dies with a nonlinear algorithm relative to increasing pressure of the fluid.

8. The system according to claim 1, wherein the inputting means is a manual inputting means for manually inputting into the system die size and the targeted crimp diameter, the system further comprising computing means for allowing one of the die size and the targeted crimp diameter to be manually input in metric units and the other of the die size and the targeted crimp diameter to be manually input in English units.

9. The system according to claim 1, further comprising means for limiting the number of crimping operations that can be performed with the system before requiring manual input of a measured crimp diameter.

10. A system for crimping a fitting to an end of a fluid conduit, the system comprising:

means for crimping the fitting to the end of the fluid conduit, the crimping means comprising a plurality of dies and a hydraulic actuator that utilizes travel of the hydraulic actuator and fluid pressure within the hydraulic actuator to apply a force that causes the dies to travel toward and contract around the fitting to a targeted crimp diameter, the dies when fully contracted defining a closed crimp diameter;

means for inputting into the system the targeted crimp diameter for the fitting and the closed crimp diameter of the dies; and means for attaining the targeted crimp diameter for the fitting by automatically increasing the travel of the hydraulic actuator based on the fluid pressure of the hydraulic actuator at the targeted crimp diameter, the attaining means utilizing the travel of the hydraulic actuator and the fluid pressure within the hydraulic actuator as inputs from which the attaining means automatically increases the travel of the hydraulic actuator to increase the contraction of the dies around the fitting beyond the targeted crimp diameter and thereby automatically compensate for spring-back of the fitting during crimping and deflection of the crimping means during crimping.

11. The system according to claim 10, wherein the attaining means automatically increases the travel of the hydraulic actuator with a nonlinear algorithm relative to increasing fluid pressure within the hydraulic actuator.

12. The system according to claim 10, wherein the attaining means automatically increases the travel of the hydraulic actuator with an exponential compensation algorithm relative to increasing fluid pressure within the hydraulic actuator.

13. The system according to claim 10, wherein the inputting means is a manual inputting means for manually inputting into the system the closed crimp diameter and the targeted crimp diameter, the system further comprising computing means for allowing one of the closed crimp diameter and the targeted crimp diameter to be manually input in metric units and the other of the closed crimp diameter and the targeted crimp diameter to be manually input in English units.

14. The system according to claim 10, further comprising means for limiting the number of crimping operations that can be performed with the system before requiring manual input of a measured crimp diameter.

15. A process of crimping a fitting to an end of a fluid conduit, the system comprising:

inputting into the system a targeted crimp diameter for the fitting around the end of the fluid conduit;

crimping the fitting to the end of the fluid conduit with a crimping means comprising a plurality of dies and an actuating means for applying a force to cause the dies to travel toward and contract around the fitting to the targeted crimp diameter; and during the crimping step, attaining the targeted crimp diameter for the fitting by automatically increasing the contraction of the dies around the filling based on the force applied by the actuating means at the targeted crimp diameter and thereby compensate for at least one of spring-back of the fitting during crimping and deflection of the crimping means during crimping.

16. The process according to claim 15, wherein the attaining step comprises automatically increasing the contraction of the dies by automatically increasing travel of the actuating means to attain the targeted crimp diameter.

17. The process according to claim 16, wherein the attaining step comprises utilizing travel of the actuating means as an input from which the attaining means automatically increases the contraction of the dies.

18. The process according to claim 15, wherein the attaining step automatically increases the contraction of the dies with a nonlinear algorithm relative to increasing force applied by the actuating means.

19. The process according to claim 15, wherein the actuating means comprises a hydraulic cylinder actuated with fluid under pressure, and the attaining step comprises utilizing the pressure of the fluid as an input from which the attaining means automatically increases the contraction of the dies.

20. The process according to claim 19, wherein the attaining step automatically increases the contraction of the dies with a nonlinear algorithm relative to increasing pressure of the fluid.

21. The process according to claim 15, wherein the inputting step is a manual inputting step and comprises manually inputting into the system die size and the targeted crimp diameter, wherein one of the die size and the targeted crimp diameter is manually input in metric units and the other of the die size and the targeted crimp diameter to be manually input in English units.

22. The process according to claim 15, further comprising limiting the number of crimping operations that can be performed with the process before requiring manual input of a measured crimp diameter.

* * * * *